United States Patent [19]

Stuckmann et al.

[11] 4,068,485

[45] Jan. 17, 1978

[54] APPARATUS FOR DRIVING TUNNELS OR THE LIKE

[75] Inventors: Dieter Stuckmann, Selm; Hans Jütte, Dortmund-Brechten; Siegmund Babendererde, Bad Vilbel; Reinhard Bokemeyer, Offenbach, all of Germany

[73] Assignees: Gewerkschaft Eisenhutte Westfalia, Lunen; Hochtief AG, Frankfurt, both of Germany

[21] Appl. No.: 710,820

[22] Filed: Aug. 2, 1976

[30] Foreign Application Priority Data

Aug. 5, 1975 Germany ..... 2534860

[51] Int. Cl.[2] ..... E01G 3/00

[52] U.S. Cl. ..... 61/85

[58] Field of Search ..... 61/85, 84, 45 R, 45 D, 61/43, 30; 299/31

[56] References Cited

FOREIGN PATENT DOCUMENTS

| | | | |
|---|---|---|---|
| 1,170,985 | 5/1964 | Germany | 61/85 |
| 1,165,815 | 10/1969 | United Kingdom | 61/85 |

*Primary Examiner*—Jacob Shapiro

*Attorney, Agent, or Firm*—Sughrue, Rothwell, Mion, Zinn and Macpeak

[57] ABSTRACT

Tunnel-driving apparatus utilizes a plurality of elongate drive or knife members arranged side-by-side and supported and guided for longitudinal movement on a frame. The members and the frame are advanced in succession during the driving process. Some or all of the drive members are hollow and accommodate telescopically extendible and retractible devices, conveniently of tubular form, used for treating the working face, for example, by conveying fluid to or from the face. The devices each have a series of cam-like projections engageable with spring-biased stops supported on the frame and the drive members. These stops serve to lock the devices in various positions and to automatically extend the devices from the members when the frame is shifted.

The stops can be displaced however to generally engage the projections in such manner as to allow or prevent movement of the devices inwardly or outwardly of the drive members.

17 Claims, 5 Drawing Figures

APPARATUS FOR DRIVING TUNNELS OR THE LIKE

BACKGROUND OF THE INVENTION

The present invention relates to apparatus for use in driving tunnels, galleries, trenches — open or otherwise, similar excavations and for convenience referred to hereinafter as "tunnels or the like".

When tunnels or the like are being formed in water-bearing strata by conventional apparatus it is known to utilize ancillary equipment including suction lances to withdraw water from the working. The use of such equipment is complicated, time consuming and costly and adversely affects the efficiency of the overall operation. There is thus a need for an improved form of apparatus and a general object of this invention is to provide such an apparatus.

SUMMARY OF THE INVENTION

In its broadest aspect the invention provides apparatus for use in driving tunnels or the like; said apparatus having an advanceable drive shield provided with devices extendible from the front of the shield to treat the working face. The treatment of the working face contemplated by the invention is primarily, but not exclusively withdrawing water by suction and processes such as ejecting fluid under pressure against the face to assist in breaking up the face. Accordingly in another aspect the invention provides apparatus for use in driving tunnels or the like; said apparatus having an advanceable drive shield provided with hollow devices extendible from the front of the shield to treat the working face by withdrawing water or by conveying fluid under pressure thereto.

Preferably means such as cams or the like are provided for selectively locking the devices in various positions and/or for automatically extending the devices at certain stages during the driving operation. In the case where the drive shield is of continuous cylindrical form, the devices can be distributed around the periphery of the shield and movable therewith. The extension of the devices for operation can then be effected manually or by a suitable mechanism such as an hydraulic unit or units or by spindles or the like.

Where the drive shield is composed of a plurality of elongate drive members mounted side-by-side on a support frame which supports and guides the members for longitudinal displacement the invention can be realized by making at least some of these drive members hollow and by mounting the devices for movement longitudinally of these members. To this end guides can be provided in the hollow members with the devices located in the guides for telescopic movement.

The provision of the devices enables various operations, such as the water removal and other face treatment referred to above to be performed efficiently. Nevertheless, the devices may not be needed in some circumstances and here it is convenient to retract the devices inside the members or the shield and to close off the guides with suitable covers or flaps. It is desirable, however, to provide for removal or insertion of the devices from the rear of the members or the shield by leaving the shield or the members and the guides open at the rear end. Thus where the devices are not needed at all they can be withdrawn from the members or the shield quite easily.

Where the drive shield is composed of drive members supported on a frame, means such as hydraulic rams are usually provided to alternatively move the members, individually or in groups and the frame in the advancing direction towards the working face. It is then desirable to design the apparatus so that the relative movement between the members and the frame extends the devices forwardly. To this end means, such as cams or the like can be arranged between the frame and the devices so as to engage and extend the devices when the frame is shifted up. In one constructional form, a series of projections can be provided on each device which ride over a spring-biased stop carried by the frame in the manner of a ratchet. When the device is moved with its drive member the stop may then engage on one of the projections to prevent the retraction of the device and thereby ensure the device is moved with the frame to extend from the drive member as the frame is shifted. The projections and the associated stop may have interengageable faces designed to engage and to inhibit movement of the device.

Preferably the stops are mounted for swivelling so that the stops can be orientated to allow or inhibit retraction of the devices into the drive members. To avoid interference with the displacement of the drive members, the stops of the frame can be mounted in sleeves which project through slotted apertures in the members. The drive members may also each have a spring-biased stop similar to those of the frame and engageable with the projections of its associated device to permit or inhibit movement of the device relative to the drive member and the guide. Again it is preferable to mount the stops of the drive members for swivelling so that the stops can be orientated to allow or inhibit retraction of the devices into the drive members. As with the stops of the frame, the stops of the drive members can be located in sleeves and slots in the guides can receive the projections.

The provision for swivelling of the stops enables the devices to remain inactive within the drive members whenever desired and the facility for automatic extension of the devices will be rendered inoperative. Nevertheless, the devices can be extended manually or the stops easily re-orientated by a wrench or other suitable tool when the automatic extension facility is again desired. The stops can reliably prevent the devices from retracting under the reactive pressure from the working face but again by re-orientating the stops the devices can be allowed to retract whenever desired.

The characteristic of re-orientating the stops for different actions on the devices can be achieved by providing faces both perpendicular and diametric to the tunnel axis and inclined thereto on the stops and the projections. Thus each projection may have an inclined front face and a perpendicular rear face while each stop may have an inclined rear face and a perpendicular front face when orientated to inhibit retraction of the device. The stop may then be swivelled through 180° to bring its inclined face to the front thereby allowing the passage of a projection or projections and the retraction of the device in question.

As will become apparent hereinafter the invention also provides apparatus for use in driving tunnels or the like and comprising a plurality of elongate drive members arranged side-by-side, a frame supporting the members for longitudinal displacement, means for relatively shifting the members and the frame to effect advancement of the tunnel, devices mounted to move with at least some of the drive members and means for automatically extending said devices from the drive members when the frame is shifted relative to the member to thereby bring the devices into a position for treating the working face in front of the drive members.

The invention may be understood more readily, and various other features of the invention may become apparent, from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
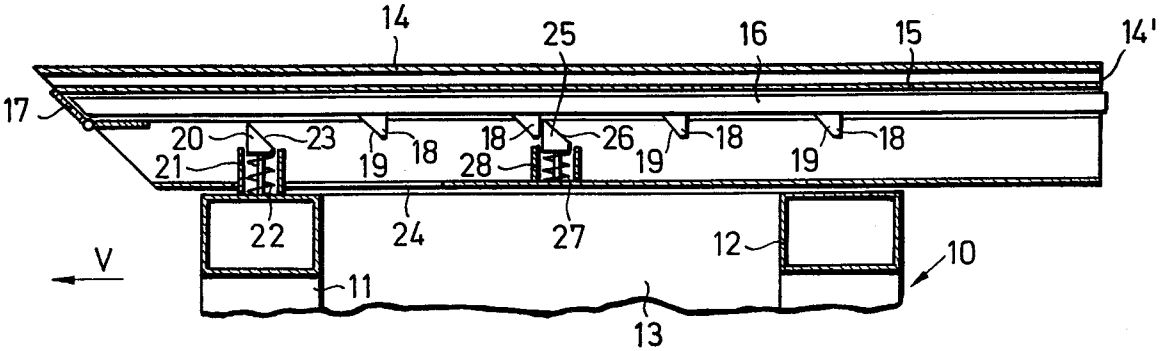
FIGS. 1 to 3 are sectional side views of a single drive member of a drive shield of apparatus made in accordance with the invention showing the components thereof in different operating positions.

In general, apparatus constructed in accordance with the invention and as described hereinafter is used in driving tunnels, galleries, trenches or similar excavations especially in water-bearing soil. As shown in the drawings, and as is generally known in the art, the apparatus has a rigid support frame 10 which supports and slidably guides a plurality of elongate drive members 14 also referred to as knives or planks. The members 14 are arranged side-by-side in parallel relationship in contact with the wall of the tunnel or other excavation to form a shield. The members 14 are each individually displaceable in a longitudinal sense in the tunnel driving direction V (FIG. 1). The frame 10 is here composed of two ring structures 11, 12 spaced apart in the driving or advancement direction V and interconnected by means of longitudinal and diagonal frame parts generally designated 13.

To advance the members 14 and the frame 10, means (not shown) such as double-acting hydraulic rams are provided. Such rams would be normally articulated to the frame 10 and to one, or a group, of the members 14. The rams can then advance the members 14 individually or in groups in succession. When the members 14 have been advanced in the direction V by the working stroke of the rams the frame 10 would be shifted up to follow the advanced members 14. In this frame-shifting operation the rams would be operated in unison in a reverse sense with the members 14 lying in frictional contact with the tunnel wall acting as an abutment. The sequence would then be repeated. The foregoing features are well known per se.

When the members 14 are advanced they usually penetrate a working face at the front end of the tunnel. Material can be removed and transported away from the face by any known method. In the case where the material is water bearing and otherwise the features which will now be described are especially useful.

Figure 2:
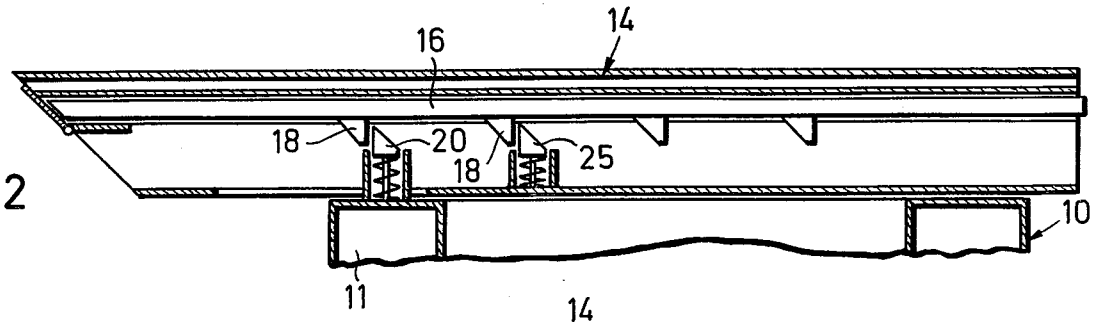
Figure 3:
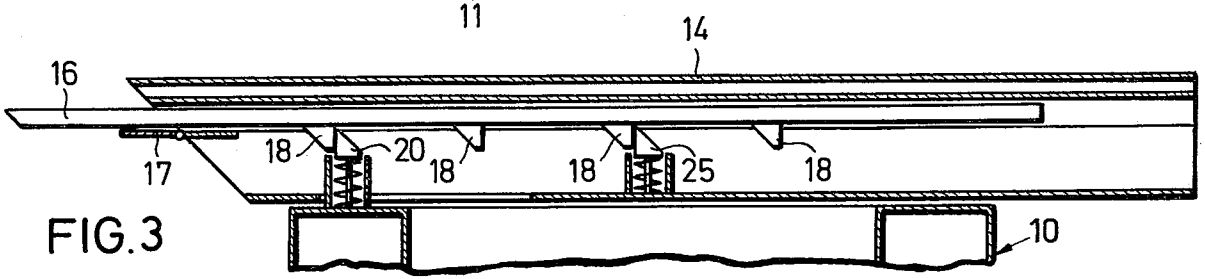
Figure 4:
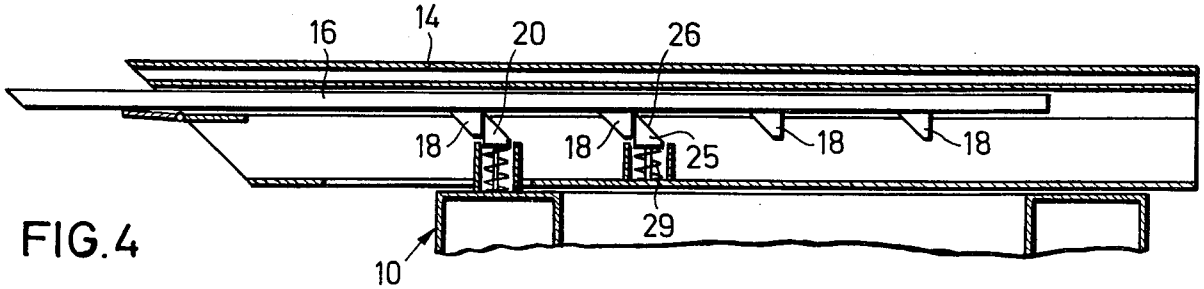
FIGS. 4 and 5 are views generally corresponding to FIGS. 1 to 3 and showing a modified extendible device in different operating positions.
Figure 5:
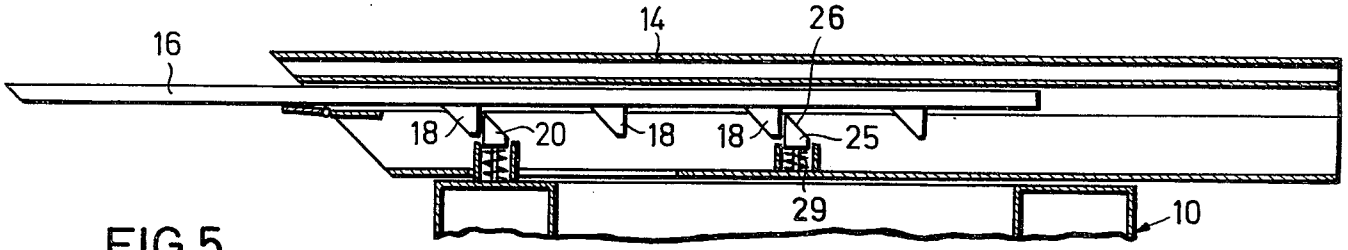

In accordance with the invention and as shown in the drawings, the members 14 are of hollow boxlike cross section having an upper or outer surface and a lower or inner surface. A guide 15, conveniently of tubular form, is provided within some or all of the members 14. The guides 15 can be welded into the members 14. A hollow device 16 used for the purposes described hereinafter and again of tubular form is slidably mounted within each guide 15 so as to be extendible and retractible in a telescopic manner. Each guide 15 extends over the entire length of its associated member 14 and is open at the rear end 14 (FIG. 1) to permit the device 16 thereof to be inserted or withdrawn from the rear. Each device 16 is of such a length to permit the device 16 to be fully retracted and housed within its guide 15. At its front end adjacent the working face, each guide 15 is provided with a flap or cover 17 which is hinged and preferably spring biased to its closed position to permit the guide 15 to be closed off or opened to allow the device 16 to extend out therefrom. FIGS. 1 and 2 show the fully retracted position of the device 16 with the cover 17 closing off the guide 15 whereas FIGS. 3 to 5 show the device 16 extending out from the guide 15 with the cover 17 pivoted to an open position.

Each guide 15 has an elongate slot and the associated device 16 has a set of cams or saw-tooth like projections 18 on its exterior which engage through this slot. The front faces 19 of these projections 18 are inclined as shown whereas the rear faces of the projections 18 are perpendicular or diametric to the tunnel axis. The foremost ring structure 11 of the frame 10 is provided with radial sleeves 21 each slidably guiding a cam follower or complementary stop 20 engageable with the projections 18 of an associated device 16. The sleeves 21 also accommodate springs 22 which resiliently bias the stops 20 outwardly perpendicular to the driving direction V. The stops 20 each have a rear face 23 inclined as shown to correspond with the faces 19 of the associated projections 18 and a front face perpendicular to the tunnel axis. The sleeves 21 project through slots 24 (FIG. 1) in the members 14 provided with the guides 15 so that these members 14 can be displaced in relation to the frame 10 as described hereinbefore without hinderance by the sleeves 21. The members 14 provided with guides 15 are also provided with further sleeves 28 at their central regions. In a similar manner to the sleeves 21, each sleeve 28 slidably guides a further cam follower or complementary stop 25 engageable with the projections 18 of the associates device 16. The sleeves 28 similarly accommodate springs 27 which resiliently bias the stop 25 outwardly perpendicular to the driving direction V. As with the stops 20, the stops 25 each have a rear face 26 which is inclined to correspond with the faces 19 of the projections 18 as well as a front perpendicular face. Engagement between the relatively moving faces 19, 23 or 19, 26 will tend to urge the stops 20, 25 inwards.

However the stops 20, 25 are each capable of being swivelled through 100° about the axis 29 (FIGS. 4 and 5) of the sleeves 21, 28 to thereby bring the inclined faces 23, 26 to the front. In this case engagement between these faces 23, 26 and the relatively moving rear faces of the projections 18 will again tend to move the stops 20, 25 inwards. Preferably detents or the like bias the stops 20, 25 into the two alternative positions. In general, therefore the devices 16 can be extended or retracted as desired. Nevertheless, the arrangement is such as to enable the devices 16 to be extended automatically as the drive shield advances as will now be described.

As shown in FIG. 1, the device 16 depicted therein is completely retracted within the member 14 and the cover 17 closes the front end of the guide 15. The front or first projection 18 is disposed between the stops 20, 25 and the second projection 18 from the front has its rear face closely adjacent the front face of the stop 25. As will be appreciated the following description is related to the single member 14 depicted in the drawings but the same sequence of events occurs with all the members 14 provided with the guides 15 and devices 16.

FIG. 2 shows the components after the member 14, in question has been shifted up in the direction V.

During the advancing of the member 14 the front face 19 of the first projection 18 engages with the rear face 23 of the stop 20 thereby urging the stop 20 inwards to permit the device 16 and the member 14 to shift until the stop 20 is free of the projection 18 whereupon the spring 22 biases the stop 20 outwards again so that the rear face of the projection 18 is closely adjacent the front face of the stop 20 as shown in FIG. 2. The stop 25 maintains its positional relationship with the second projection 18 as also shown. It will be recalled that when the members 14 have all been advanced the frame 10 is shifted up.

FIG. 3 shows the positional relationships when the frame 10 has been shifted up. As can be appreciated from FIGS. 2 and 3 as the frame 10 is displaced the front face of the stop 20 engages on the rear face of the front projection 18 so that the device 16 is extended with the frame 10. The cover 17 is automatically pivoted by the extending device 16 although it is possible to open the cover 17 separately. As the device 16 extends the front face 19 of the third projection 18 from the front engages the rear face 26 of the stop 25 and the stop 25 is urged inwards by the projection 18 against the force of the spring 27 to permit the extension of the device 16. When the device 10 has been advanced with the frame 10 in this manner the first and third projections 18 have their rear faces in abutting relationship with the front faces of the stops 20, 25 thereby preventing inward movement of the device 16 under reactive force from the working face. By swivelling the stops 20, 25 through 180° with a suitable tool the device 16 can be unlocked so that it will be retracted by the reactive pressure of the face or otherwise.

The devices 16 can be connected up to a suction pump in order to withdraw water from the face. Alternatively a source of compressed air or water under pressure can be connected to the devices to assist in breaking up the face. Other forms of treatment are also possible.

If the device 16 is to maintain the extended position shown in FIG. 3 the stop 20 would be swivelled back and forth through 180° so that the device 16 advances with the member 14 but the movement of the frame 10 does not cause further extension of the device 16. It is possible to design the cover 17 so that it permits the passage of the first projection 18 thereby permitting the device 16 to be extended further from the position shown in FIG. 3. Alternatively, as representated in FIGS. 4 and 5, the projections 18 can be positioned closer to the rear of the device 16 as compared with FIGS. 1 to 3. In this case after shifting of the member 14 the device 16 would adopt the position shown in FIG. 4 (c.f. FIG. 2) and when the frame 10 is shifted the device 16 would be further extended by the stop 20 with the third projection 18 riding over the stop 25 to finish up in the position shown in FIG. 5.

We claim:

1. In an apparatus for use in driving tunnels or the like and which employs a plurality of elongate drive members arranged side-by-side and a frame for supporting the drive members for longitudinal displacement the members and the frame being advanced in succession towards a working face as the driving progresses; the improvement comprising a plurality of devices movable with at least some of the drive members and means of automatically extending said devices from the drive members when the frame is shifted to bring the devices into a position for treating the working face.

2. Apparatus according to claim 1, wherein said at least some drive members are hollow and the devices are mounted inside the drive members and are guided for movement longitudinally thereof.

3. Apparatus according to claim 2, wherein each device is accessible for withdrawal or insertion at the rear end of the associated drive member remote from the working face.

4. Apparatus according to claim 1, wherein said at least some drive members are hollow and the devices are located in guides within said members for extension or retraction in telescopic manner.

5. Apparatus according to claim 1, wherein means is provided for selectively locking the devices in different extension positions.

6. Apparatus according to claim 5, wherein said extending means comprises interengageable projections and stops on the frame and the devices.

7. Apparatus according to claim 6, wherein each device has a series of spaced-apart projections and there are spring-biased stops on the frame each operably associated with the series of projections of a respective one of the devices, the projections and associated stop having interengageable faces designed to engage and displace the stop against the spring force as the device is moved to thereby permit the movement of the device and interengageable faces designed to engage and to inhibit movement of the device.

8. Apparatus according to claim 7, wherein the stops on the frame are mounted for swivelling so that the stops can be orientated to allow or inhibit retraction of the devices into the drive members.

9. Apparatus according to claim 7, wherein the stops are mounted in sleeves on the frame and the drive members provided with devices have slotted apertures therein through which the sleeves extend.

10. Apparatus according to claim 7, wherein the drive members provided with the devices each has a spring-biased stop generally complementary to the associated stop on the frame and having faces interengageable with faces of the projections of the associated device to permit or inhibit movement of the device relative to the drive member and the guide.

11. Apparatus according to claim 10, wherein the stops on the drive members are mounted for swivelling so that the stops can be oriented to allow or inhibit retraction of the devices into the drive members.

12. Apparatus according to claim 10, wherein each guide has a slotted aperture through which the projections of the associated device extend.

13. Apparatus according to claim 4, wherein each guide has a spring-biased cover at its front end which is biased to close the guide to the working face and which is movable to open the guide to permit extension of the device therein.

14. In an apparatus for use in driving tunnels or the like and which employs a drive shield with inner and outer walls advanceable towards a working face as the driving process progresses; the improvement comprising a plurality of hollow suction devices mounted in the drive shield between the inner and outer walls and means for extending said devices from the front of the shield to treat the working face by withdrawing water therefrom.

15. In an apparatus for use in driving tunnels or the like and which employs a drive shield with inner and outer walls advanceable towards a working face as the driving process progresses; the improvement comprising a plurality of hollow devices mounted in the drive shield between the inner and outer walls and means for extending said devices from the front of the shield to treat the working face by conveying fluid under pressure thereto.

16. An apparatus according to claim 15, wherein means is provided for automatically extending said devices when the drive shield is advanced.

17. Apparatus according to claim 14, wherein means is provided for automatically extending said devices when the drive shield is advanced.

* * * * *